United States Patent [19]

Lohse

[11] Patent Number: 4,796,559

[45] Date of Patent: Jan. 10, 1989

[54] APPARATUS FOR APPLYING A LIQUID TO A WEB OF MATERIAL

[75] Inventor: Walter Lohse, Herisau, Switzerland

[73] Assignee: Ulrich Steinemann AG, St. Gallen, Switzerland

[21] Appl. No.: 51,142

[22] PCT Filed: Jul. 28, 1986

[86] PCT No.: PCT/CH86/00109

§ 371 Date: Apr. 17, 1987

§ 102(e) Date: Apr. 17, 1987

[87] PCT Pub. No.: WO87/01401

PCT Pub. Date: Mar. 12, 1987

[30] Foreign Application Priority Data

Sep. 4, 1985 [CH] Switzerland ..... 3806/85

[51] Int. Cl.[4] ..... B05C 1/08

[52] U.S. Cl. ..... 118/210; 118/262

[58] Field of Search ..... 118/210, 259, 262

[56] References Cited

U.S. PATENT DOCUMENTS

| | | | |
|---|---|---|---|
| 2,513,394 | 7/1950 | Barrett et al. | 118/262 X |
| 2,946,307 | 7/1960 | Warner | 118/259 X |
| 3,716,019 | 2/1973 | Carter et al. | 118/262 X |
| 3,926,148 | 12/1975 | Honsel | 118/262 X |
| 4,237,816 | 12/1980 | Shimono et al. | 118/249 |

FOREIGN PATENT DOCUMENTS

| | | |
|---|---|---|
| 1815490 | 7/1969 | Fed. Rep. of Germany . |
| 2911166 | 10/1980 | Fed. Rep. of Germany . |
| 1094615 | 5/1955 | France . |

*Primary Examiner*—John McIntosh

*Attorney, Agent, or Firm*—William R. Hinds

[57] ABSTRACT

The applicator roller (2) can be driven in both directions of rotation. For coating the web of material (3) in the counter-directional mode, a distributor roller (6) is brought up to the applicator roller. In that way it is possible for the film of liquid (1) to be taken from the same reservoir zone (5) as in the co-directional mode of operation. That saves shifting the metering roller (4) which remains at the same position both in the co-directional mode and in the counter-directional mode of operation.

11 Claims, 3 Drawing Sheets

Fig. 1
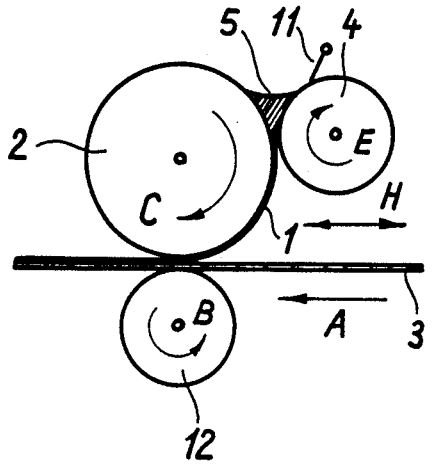
Fig. 2
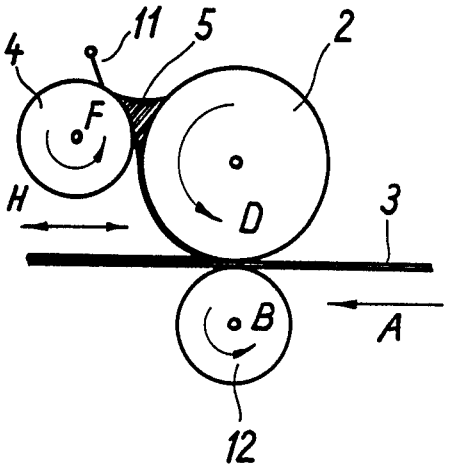
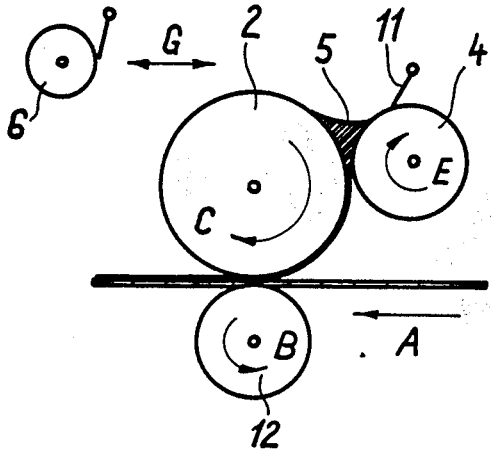
Fig. 3
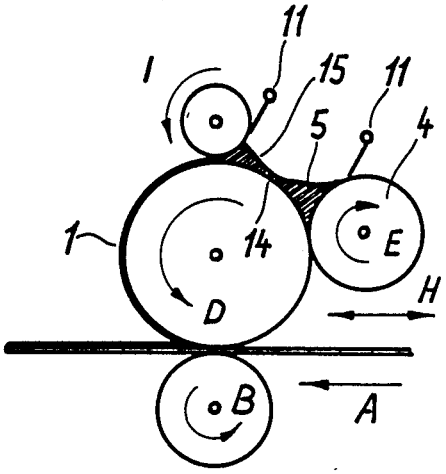
Fig. 4

APPARATUS FOR APPLYING A LIQUID TO A WEB OF MATERIAL

The invention relates to an apparatus for applying a liquid to a web of material.

Apparatuses of that kind are used for example on roller lacquering or enamelling machines for lacquering or enamelling paper or cardboard. The web of material which has possibly been subjected to a preliminary treatment and which may or may not have printing thereon is moved past the applicator roller which applies a film of lacquer to the web of material. The coated web is then passed to a drier which for example depending on the nature of the lacquer causes hardening or drying of the coating by UV-polymerisation or by means of infrared irradiation.

Known roller lacquering or enamelling machines can apply the film of lacquer to the web of material in a co-directional or a counter-directional mode. However, to change the mode of operation of the machine, it is necessary to convert the machine: when providing a coating in the co-directional mode, the reservoir zone is arranged upstream of the point of entry of the web of material into the applicator roller, as considered in the direction of feed of the web of material, while in a counter-directional coating mode the metering roller or the reservoir zone is arranged downstream of the applicator roller as considered in the direction of feed movement of the web of material. In both situations, the film of lacquer leaves the reservoir zone with the liquid to be applied through a thin gap formed between the metering roller and the applicator roller.

In order to convert the machine from the co-directional coating mode to the counter-directional coating mode, either a second metering roller has to be moved towards the applicator roller and the first metering roller has to be taken out of engagement, or it is necessary to provide separate mounting locations for the metering roller in both modes of operation, which then requires conversion of the coating installation in each case. In that connection, particular problems are encountered in regard to the feed of liquid or lacquer to be applied to the two metering rollers, or in regard to conversion thereof, for different modes of operation. Conversion is also very expensive as it is first necessary to clean the rollers, for which purpose the liquid which is still to be found in the reservoir zone has to be removed. The conversion operation takes time and requires operating personnel.

An object of the present invention is therefore of providing an apparatus of the kind set forth in the opening part of this specification, wherein conversion of the metering roller is no longer necessary and in which the film of liquid is taken from the same reservoir zone both in the co-directional coating mode and also in the counter-directional coating mode.

In accordance with the invention, there is provided apparatus for applying a liquid to a web of material, comprising an applicator roller, means for driving the applicator roller in both directions of rotation, means for advancing the web of material under the applicator roller tangentially in relation to the surface thereof such that it moves in the same direction as or in the opposite direction to the direction of movement of the adjacent surface of the roller dependent upon the direction of rotation of the roller, and a metering roller which can be adjusted toward the applicator roller and which is so arranged that in conjunction with the applicator roller it forms a reservoir zone for the liquid to be applied, such that in a first direction of rotation of the applicator roller the liquid will flow downwardly through a gap formed at the bottom of the reservoir zone between the applicator roller and the metering roller and from there is conveyed by the applicator roller directly onto the web of material, and in a second opposite direction of rotation of the applicator roller the liquid is conveyed away from the reservoir zone freely upwardly and is conveyed as a liquid film by the applicator roller over the highest point of the applicator roller and onto the web of material, and wherein there is provided a drivable distributor roller which, when the applicator roller is driven in the second opposite direction, can be adjusted toward the applicator roller in the region of the liquid film between the reservoir zone and the line of contact between the web of material and the applicator roller, such that the liquid to be applied is metered by a gap formed between the distributor roller and the applicator roller, and means comprising an adjusting device for so adjusting the distributor roller.

The retention of the metering roller on one side of the applicator roller and the provision of the additional distributor roller which can be cut into or taken out of operation, makes it possible in a simple manner to provide a coating operation in the co-directional mode and in the counter-directional mode, only with one metering roller. In the co-directional coating mode the additional distributor roller is uncoupled and pivoted away and in itself doesnot perform any function. The coating operation is effected in per se known manner by the film of liquid being removed downwardly from the reservoir zone through the gap between the metering roller and the applicator roller and being applied to the web of material in the same direction as the feed movement thereof. In order now to be able to coat a web of material in the counter-directional mode, using the same apparatus, it is only necessary to alter the direction of rotation of the applicator roller and to bring the distributor roller into operation. The film of liquid is removed from the same reservoir zone but upwardly relative to the apex or highest point of the applicator roller. In order to ensure that there is a uniform film of fluid on the applicator roller, the distributor roller now performs the actual metering function.

It is particularly advantageous for the distribution roller to be adapted to be applied to the upper half of the applicator roller approximately in the region of the highest point thereof. In that way any excess liquid which accumulates upstream of the gap between the distributor roller and the applicator roller can flow back into the reservoir zone.

The distributor roller is preferably adapted to be driven in the opposite direction to the applicator roller, thus providing for optimum distribution of the film of liquid. Preferably the distributor roller is drivable by a transmission which can be coupled to the shaft of the applicator roller. That ensures that the distributor roller always rotates in the correct direction in the counter-directional mode of operation. The transmission and the distributor roller preferably form a unit which is displaceable towards and away from the applicator roller by means of an adjusting device. In that way drive components do not have to be driven unnecessarily in the co-directional mode of operation in which the distributor roller does not perform any function.

If the adjusting device has at least one toothed rack which meshes with a gear on the displaceable unit in such a way that the unit is displaceable by rotation of the gear, along the rack, the transmission unit may be brought into the operative position, with the distributor roller, without the application of force, and can be easily brought into the coupled condition.

An embodiment of the invention is described in greater detail hereinafter and illustrated in the accompanying drawings in which:

FIG. 1 shows a known apparatus in the co-directional mode,

FIG. 2 shows a known apparatus in the counter-directional mode,

FIG. 3 shows an apparatus according to the invention in the co-directional mode, FIG. 4 shows an apparatus according to the invention in the counter-directional mode.

Figure 5:
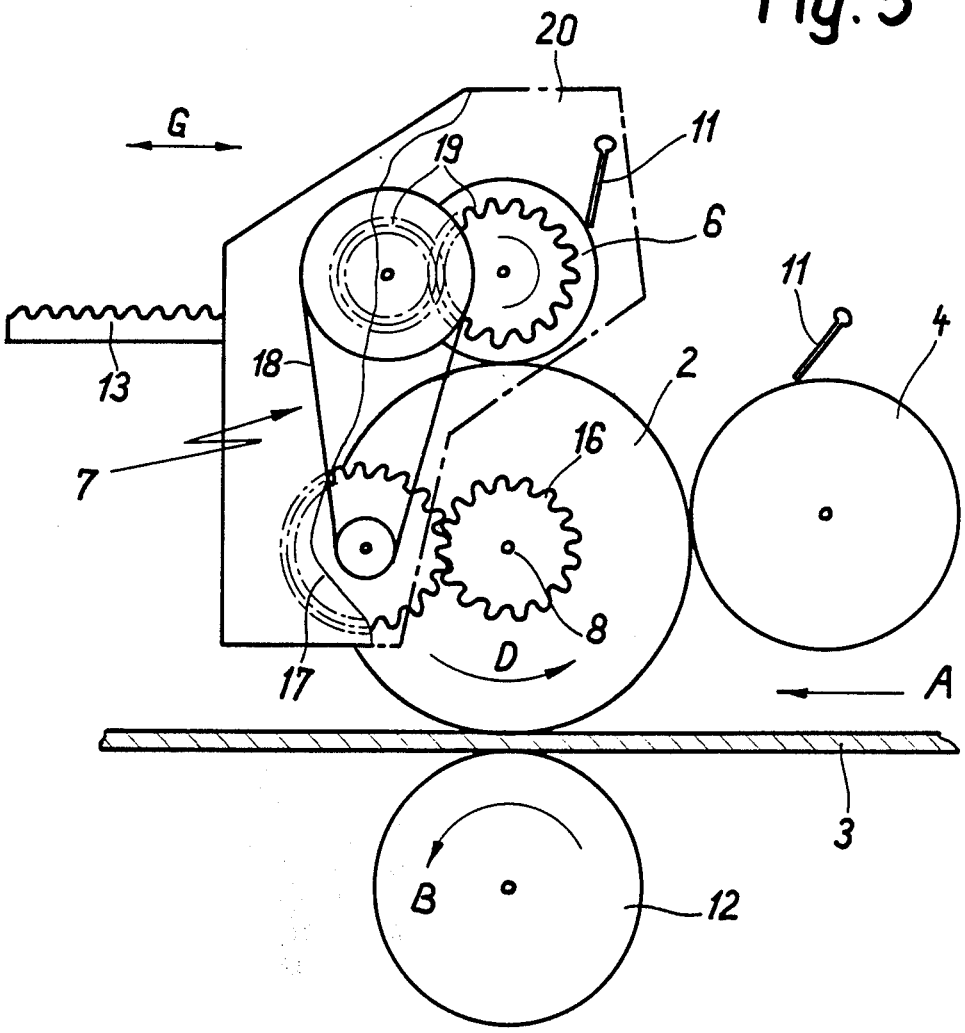
FIG. 5 shows a side view of an apparatus according to the invention with transmission components illustrated in diagrammatic form.

FIGS. 1 and 2 show the mode of operation of a per se known apparatus. An applicator roller 2 can be driven in both directions of rotation as indicated by C and D. The web of material 13 is always advanced in the direction indicated by the arrow A and is pressed against the applicator roller by the counterpressure roller 12 which rotates in the direction indicated by the arrow B in the same direction as the web of material 3. Arranged upstream of the applicator roller 2 in the direction of feed movement of the material is a metering roller 4 which can be adjusted in the direction indicated by the arrow H. The metering roller 4, together with the applicator roller 2, at 5 forms a reservoir zone for the liquid to be applied. A film of liquid is drawn from the reservoir zone through the gap between the applicator roller 2 and the metering roller 4 and transferred on to the web of material 3. The liquid which remains clinging to the metering roller 4 is scraped off with a doctor 11.

For coating the web of material in the counter-directional mode, the metering roller 4 is now dismounted and re-installed again at prepared mounting means, downstream of the applicator roller 2 as considered in the direction of feed of the material. In that position, the metering roller 4 can be adjusted in the direction indicated by the arrow H. However the applicator roller 2 now rotates in the direction indicated by the arrow D, in the opposite direction to the feed movement of the web of material 3. By virtue of that arrangement the film of liquid is not pressed on to the web of material but is stripped or wiped off on the surface of the web of material. Before the metering roller 4 can be changed, it will be seen that firstly the liquid in the reservoir zone 5 has to be drained away, and a fresh liquid feed means has to be connected into the arrangement, in the position for counter-directional operation.

The apparatus according to the invention is illustrated in FIGS. 3 and 4. In FIG. 3, the arrangement of the rollers and the directions of rotation are the same as in FIG. 1 and the mode of operation is also unaltered. The arrangement additionally includes a distributor roller 6 which can be adjusted in the direction indicated by the arrow G but which remains in a waiting position in the co-directional mode of operation of the apparatus.

If the applicator apparatus is to be operated in the counter-directional mode, the distributor roller 6 is adjusted towards the applicator roller 2, as shown in FIG. 4. With that adjusting movement, it is also coupled to the drive means for the rollers. At the same time the metering roller 4 is adjusted to the applicator roller 2 as closely as may be necessary so that the required amount of lacquer is conveyed through the gap.

The direction of rotation of the applicator roller is in turn altered for the counter-directional mode of operation of the apparatus. The film of liquid 1 is taken from the same reservoir zone 5 as in the co-directional mode of operation but it does not leave the reservoir zone in a downward direction through the gap between the applicator roller and the metering roller, but in an upward direction towards the apex of the applicator roller. The thickness of the film of liquid is relatively uncontrolled in the portion 14 between the metering roller 4 and the distributor roller 6. However distribution of the liquid and setting of the thickness of the film of liquid are effected by the distributor roller 6 which now performs a similar function to the metering roller 4 in the embodiment shown in FIG. 2. An accumulation of liquid 15 may be formed upstream of the distributor roller 6, but, with a certain amount of liquid being present, accumulated liquid can flow back into the reservoir zone 5 under the influence of the force of gravity.

The distributor roller 6 rotates in the direction indicated by the arrow I in opposition to the applicator roller 2 and also has a doctor 11.

Referring to FIG. 5, diagrammatically illustrated therein by way of example is a transmission arrangement with which the distributor roller 6 can be driven. The transmission 7 is driven by the shaft 8 of the applicator roller 2 on which a drive gear 16 is disposed. In the coupled condition, that gear 16 meshes with the gear 17 whose shaft drives a toothed belt 18. The rotary movement is finally transmitted to the distributor roller 6 by way of further gears 19.

The entire transmission 7, together with the distributor roller 6, forms a displaceable unit 20 which is displaceable along the toothed rack 13 in the direction indicated by the arrow G. The unit 20 may have for example side walls 21 which at the same time carry bearing and mounting means for the various parts of the transmission.

Figure 6:
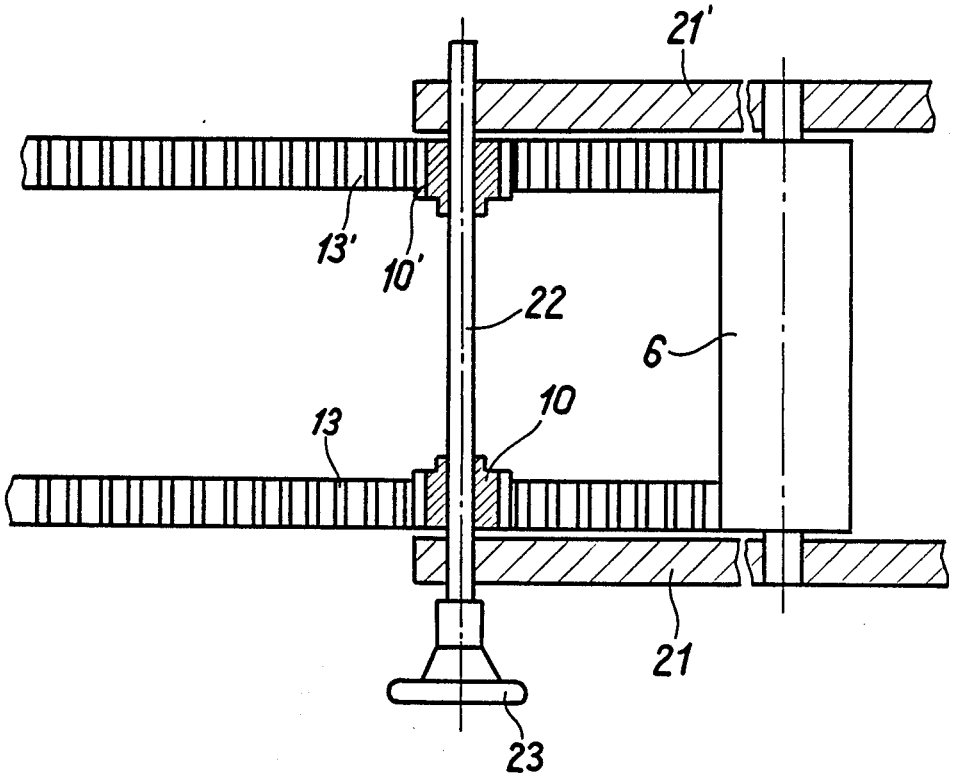
FIG. 6 is a simplified plan view of the adjusting device.

FIG. 6 shows by way of example two toothed racks 13 which are arranged in the direction of displacement G. The distributor roller 6 is mounted between the two parallel side walls 21 and 21' of the unit 20. The two side walls also form a mounting means for the shaft 22 which is provided on one side with a rotary handle 23. Arranged on the shaft 22 are the gears 10 and 10' which mesh with the racks 13 and 13'. It will be seen that rotation of the handle 23 causes the unit 20 to be moved along the racks in the direction indicated by the arrow G. When the unit is moved away, the gear 17 of the transmission comes out of engagement with the drive gear 16. The unit 20 is moved away to such a distance that it does not impede the operating procedure when the applicator roller is operating in the co-directional mode. It will be appreciated that it is also possible for the transmission to the arrangement 7 to be produced in a different manner.

The coupling arrangement shown in FIG. 6, instead of coupling to the drive of the applicator roller 2, may advantageously also couple to a drive (not shown) for the metering roller 4. That alternative embodiment would even have the advantage that the metering roller 4 and the distributor roller 6 could be regulated independently of the speed of rotation of the applicator roller 2. In that way in particular the thickness of the layer of liquid or lacquer transferred to the web of material could be adjusted completely independently of the speed of the applicator roller 2.

I claim:

1. Apparatus for applying a liquid to a web of material (3), comprising an applicator roller (2), means for driving the applicator roller in both directions of rotation, means for advancing the web of material under the applicator roller tangentially in relation to the surface thereof such that it moves in the same direction as or in the opposite direction to the direction of movement of the adjacent surface of the roller dependent upon the direction of rotation of the roller, and a metering roller (4) which can be adjusted toward the applicator roller (2) and which is so arranged that in conjunction with the applicator roller (2) it forms a reservoir zone (5) for the liquid to be applied, such that in a first direction of rotation of the applicator roller the liquid will flow downwardly through a gap formed at the bottom of the reservoir zone (5) between the applicator roller (2) and the metering roller (4) and from there is conveyed by the applicator roller directly onto the web of material, and in a second opposite direction of rotation of the applicator roller (2) the liquid is conveyed away from the reservoir zone (5) freely upwardly and is conveyed as a liquid film by the applicator roller over the highest point of the applicator roller and onto the web of material, and wherein there is provided a drivable distributor roller (6) which, when the applicator roller is driven in the second opposite direction, can be adjusted toward the applicator roller (2) in the region of the liquid film between the reservoir zone (5) and the line of contact between the web of material and the applicator roller (2), such that the liquid to be applied is metered by a gap formed between the distributor roller (6) and the applicator roller (2), and means comprising an adjusting device for so adjusting the distributor roller.

2. Apparatus according to claim 1 characterised in that the distributor roller (6) is provided at the periphery of the applicator roller between the highest point thereof and the metering roller (4) which is disposed at a lower level, in such a way that an accumulation of liquid which is formed at the entry gap between the distributor roller (6) and the applicator roller (2) can flow back into the reservoir zone (5) under the influence of the force of gravity.

3. Apparatus according to claim 1 characterised in that the metering roller (4) is disposed upstream of the applicator roller (2) in the direction of feed of the web of material (3) and that, when the applicator roller (2) is driven, the distributor roller (6) can be selectively uncoupled or driven together with the applicator roller.

4. Apparatus according to claim 3 characterised in that the distributor roller (6) can be adjusted towards the upper half of the applicator roller (2).

5. Apparatus according to claim 1 characterised in that the distributor roller (6) is adapted to be driven in the opposite direction to the applicator roller (2).

6. Apparatus according to claim 1 characterised in that the distributor roller (6) is adapted to be driven by a transmission (7) which is adapted to be coupled to the shaft of the applicator roller (2).

7. Apparatus according to claim 6 characterised in that the transmission (7) and the distributor roller (6) form a unit which is displaceable towards or away from the applicator roller (2) by means of an adjusting device.

8. Apparatus according to claim 7 characterised in that the adjusting device has at least one toothed rack (13) which meshes with a gear at the displaceable unit in such a way that the latter is displaceable by rotation of the gear, along the rack.

9. Apparatus according to claim 1 characterized in that the distributor roller (6) is adapted to be driven by a transmission which is adapted to be coupled to the shaft of the metering roller (4).

10. Apparatus according to claim 1 wherein in the first direction of rotation of the applicator roller the web of material is advanced synchronously with the applicator roller and in the second opposite direction of rotation is advanced opposite to the applicator roller, and wherein the metering roller is disposed upstream of the applicator roller relative to the direction of feed of the web of material.

11. Apparatus for applying a liquid to a web of material (3), comprising an applicator roller (2), means for driving the applicator roller in both directions of rotation, means for advancing the web of material under the applicator roller tangentially in relation to the surface thereof such that it moves in the same direction as or in the opposite direction to the direction of movement of the adjacent surface of the roller dependent upon the direction of rotation of the roller, and a metering roller (4) which can be adjusted toward the applicator roller (2) and which is so arranged that in conjunction with the applicator roller (2) it forms a reservoir zone (5) for the liquid to be applied, such that in a first direction of rotation of the applicator roller the liquid will flow downwardly through a gap formed at the bottom of the reservoir zone (5) between the applicator roller (2) and the metering roller (4) and from there is conveyed by the applicator roller directly onto the web of material, and in a second opposite direction of rotation of the applicator roller (2) the liquid is conveyed away from the reservoir zone (5) freely upwardly and is conveyed as a liquid film by the applicator roller over the highest point of the applicator roller and onto the web of material, and wherein there is provided a drivable distributor roller (6) which, when the applicator roller is driven in the second opposite direction, can be adjusted toward the applicator roller (2) in the region of the liquid film between the reservoir zone (5) and the line of contact between the web of material and the applicator roller (2), such that the liquid to be applied is metered by a gap formed between the distributor roller (6) and the applicator roller (2), and means comprising an adjusting device for so adjusting the distributor roller, the advance of the web material being synchronous with the adjacent surface of the applicator roller in the first direction of rotation of the applicator roller and being opposite to the direction of movement of the adjacent surface of the applicator roller in the second opposite direction of rotation of the applicator roller, the metering roller being disposed upstream of the applicator roller relative to the direction of feed of the web of material, a transmission coupled to a shaft of one of the applicator roller or metering roller for driving the distributor roller, said transmission and the distributor roller forming a unit which is displaceable toward and away from the applicator roller by means of said adjusting device, and said adjusting device having at least one toothed rack which meshes with a gear at the displaceable unit in such a way that the latter is displaceable along the rack by rotation of the gear.

* * * * *